US007082617B1

(12) United States Patent
Poindexter et al.

(10) Patent No.: US 7,082,617 B1
(45) Date of Patent: Aug. 1, 2006

(54) MOMMY BIB

(76) Inventors: Michael Poindexter, 12084 Rockford St., Spring Hill, FL (US) 34608; Connie Poindexter, 12084 Rockford St., Spring Hill, FL (US) 34608

( * ) Notice: Subject to any disclaimer, the term of this patent is extended or adjusted under 35 U.S.C. 154(b) by 0 days.

(21) Appl. No.: 10/711,547

(22) Filed: Sep. 24, 2004

Related U.S. Application Data

(60) Provisional application No. 60/564,185, filed on Apr. 21, 2004.

(51) Int. Cl.
*A41D 13/04* (2006.01)

(52) U.S. Cl. ..... 2/48; 2/46; 2/51

(58) Field of Classification Search ..... 2/48, 2/49.1, 49.4, 50, 51, 52, 104, 46, 88, 114, 2/468, 461, 462, 49.5, 69, 92; D2/823, 860, D2/861, 724
See application file for complete search history.

(56) References Cited

U.S. PATENT DOCUMENTS

| | | | | | |
|---|---|---|---|---|---|
| D47,264 | S | * | 4/1915 | Metzger et al | D2/724 |
| 1,722,067 | A | * | 7/1929 | Vaxes | 2/50 |
| 1,887,028 | A | * | 11/1932 | Lemke et al. | 2/50 |
| D115,604 | S | * | 5/1939 | Fadie | D2/823 |
| 2,258,946 | A | * | 10/1941 | Chadwick | 2/48 |
| D130,783 | S | * | 12/1941 | Goldenstein | D2/724 |
| 2,417,888 | A | * | 3/1947 | Schuster | 2/104 |
| D152,661 | S | * | 2/1949 | Smith | D2/724 |
| 2,482,182 | A | * | 9/1949 | Henninger | 2/48 |
| 2,528,630 | A | * | 11/1950 | Winkler | 2/114 |
| 2,794,985 | A | * | 6/1957 | Brennish | 2/48 |
| 2,857,599 | A | * | 10/1958 | Wallace | 2/48 |
| 3,514,788 | A | * | 6/1970 | Miller | 2/87 |
| 3,742,519 | A | * | 7/1973 | Wiley | 2/88 |
| 3,798,674 | A | * | 3/1974 | Daniel | 2/50 |
| 4,078,264 | A | * | 3/1978 | DeGennaro et al. | 2/88 |
| 4,697,287 | A | * | 10/1987 | Rose | 2/48 |
| 4,771,480 | A | * | 9/1988 | Stimson et al. | 2/88 |
| 4,995,116 | A | * | 2/1991 | Beauchamp et al. | 2/104 |
| 5,572,740 | A | * | 11/1996 | Geniesse | 2/46 |
| D382,091 | S | * | 8/1997 | Leahy | D2/823 |
| 5,709,000 | A | * | 1/1998 | Hansen et al. | 5/655 |
| 5,822,792 | A | | 10/1998 | Reinhart, Jr. | |
| 5,848,439 | A | * | 12/1998 | Huseth et al. | 2/104 |
| D412,388 | S | * | 8/1999 | Paolacci | D2/823 |
| 5,950,235 | A | * | 9/1999 | Tata | 2/48 |
| 6,345,392 | B1 | * | 2/2002 | Rios | 2/48 |
| 6,499,140 | B1 | | 12/2002 | Benjamin et al. | |

* cited by examiner

*Primary Examiner*—Amy B. Vanatta
(74) *Attorney, Agent, or Firm*—Thomas E. Toner; Smith & Hopen, P.A.

(57) ABSTRACT

Provided is a protective garment, much like a bib having an outer surface and inner surface for disposition over a user's clothes. The bib comprises, a back panel having an upper and a lower edge, a pair of shoulder panels extending from the upper edge of the back panel, each shoulder panel having a medial end and a lateral end, a neck opening having a peripheral border defined by the upper edge of the back panel and respective medial ends of said shoulder panels, two chest panels, each having a medial and lateral side, depending from an associated shoulder panel in laterally spaced apart relation to one another, thereby defining a generally longitudinal opening therebetween, a fastener associated with at least one of the medial sides of the chest panels for releasably joining the chest panels together in overlapping fashion so that said generally longitudinal opening is closed releasably.

5 Claims, 3 Drawing Sheets

MOMMY BIB

CROSS-REFERENCE TO RELATED DISCLOSURES

This disclosure claims priority from a provisional application filed Apr. 21, 2004 by the present inventors and bearing application no. 60/564,185.

BACKGROUND OF THE INVENTION

The use of various baby bibs, blankets and towels are well known in the art. Commonly these include bibs or garments that are placed on baby during feeding to prevent spillage or regurgitation of fluids onto the infant's clothes. Similarly, it is well known in the art to place a towel or other clothe over the shoulder of the care giver while feeding or holding an infant. However, the prior art lacks a garment which can be worn by the care giver to significantly protect the care givers clothes. Although other bibs exist, they commonly tie in the rear, much like a lobster bib, making them difficult to wear.

SUMMARY OF THE INVENTION

The inventive apparatus includes a protective garment, much like a bib having an outer surface and inner surface for disposition over a user's clothes. The bib comprises, a back panel having an upper and a lower edge, a pair of shoulder panels extending from the upper edge of the back panel, each shoulder panel having a medial end and a lateral end, a neck opening having a peripheral border defined by the upper edge of the back panel and respective medial ends of said shoulder panels, two chest panels, each having a medial and lateral side, depending from an associated shoulder panel in laterally spaced apart relation to one another, thereby defining a generally longitudinal opening therebetween, a fastener associated with at least one of the medial sides of the chest panels for releasably joining the chest panels together in overlapping fashion so that said generally longitudinal opening is closed releasably.

In one embodiment, the protective garment further comprises two sleeve panels extending from the lateral end of an associated shoulder panel and back panel, each sleeve panel extending partially over the user's upper arm thereby providing additional protection. In this, as well as many other, embodiments, the fastener being chosen from a group of fasteners consisting of hook and loop, a zipper, buttons and cloth ties. The garment may also include a fluid-resistant layer affixed to the inner surface of the garment forming a layer of protection between the user and the garment.

In yet another embodiment, the respective parts of the garment (the shoulder, chest, and sleeve panels) may be formed from, or equipped with, an absorptive material placed in "drool patterns," or those areas most likely to absorb moisture generated from caring for an infant.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The present invention is used in the typical environment in which a care giver would feed, or otherwise handle, an infant. The inventive apparatus allows the care giver significant protection, lacking in traditional bibs and towels, as well as ease of use. The protective element of the present invention is achieved by first providing complete coverage for the upper body of the care giver. This allows the care giver to switch the position of the infant without readjusting a towel or traditional bib. In one embodiment, the inventive apparatus seals in the front, like a shirt. Secondly, a soft, protective and absorbent material is integrated onto the surface of the bib. This material is not only suitable for absorbing errant fluids but also provides a comfortable chewing surface for teething infants.

The inventive apparatus comprises a vest-like garment constructed from a comfortable base material. Although the invention is not limited to the types of material which can be used, the vest will most commonly be constructed from nylon, cotton (or a poly-cotton blend), terry cloth or any combination thereof. The inventive apparatus includes, generally, five panels: two shoulder panels, two chest panels and a back panel.

Figure 1:
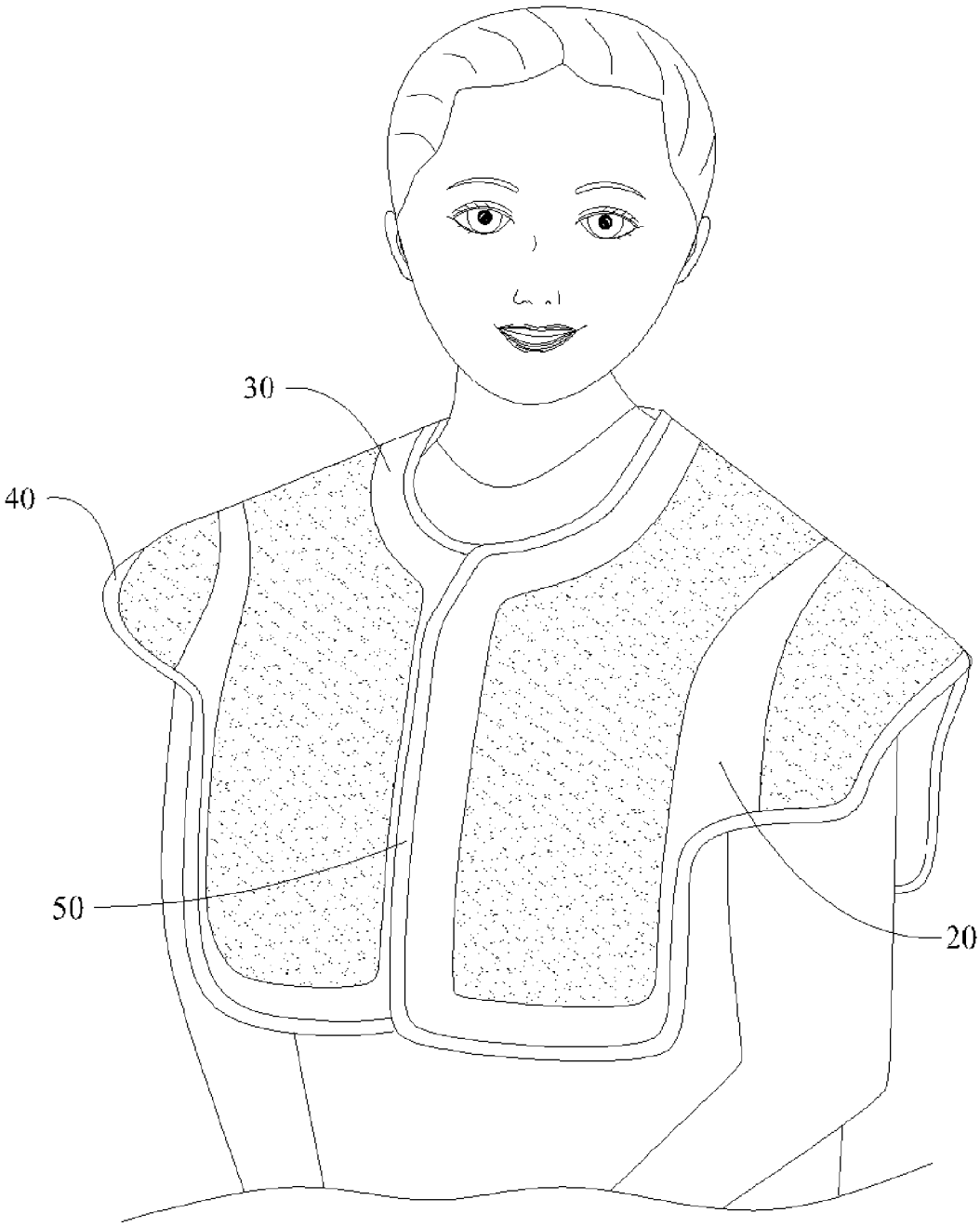
FIG. 1 is a perspective view of the inventive apparatus in use.

Referring now to FIG. 1, the two chest panels (20), separable along the garment's longitudinal axis (50), are affixed to a corresponding shoulder panels (30). Two sleeve panels (40) extend from the lateral end of an associated shoulder panel and back panel, each sleeve panel extending partially over the user's upper arm (thereby providing additional protection). That is, the garment is wearable much like a standard shirt, with the exception that the sides remain open. This feature provides two distinct advantages, first the entire front surface of the wearer is protected and second, the garment is easily adorned and removed. Types of fasteners joining the bifurcated sides include hook and loop fasteners (VELCRO), buttons, zippers and the like. The garment may also be equipped with pockets (not shown) for added convenience.

Figure 2:
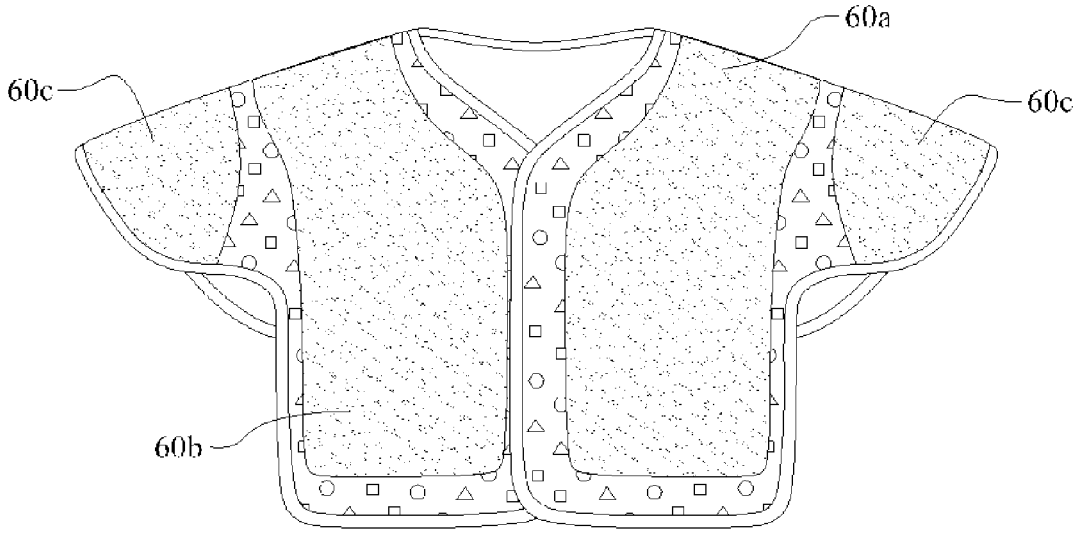
FIG. 2 is a front perspective view of the inventive garment.

As is shown in FIG. 2 an absorption material (60) can be extended from the absorption zone down the front of the garment for added security. FIG. 2 illustrates one potential arrangement of the absorption material. As it can be seen the absorptive material or patch (60), such as terry cloth, is placed in the "drool patterns." This placement indicates the greatest likelihood of spillage or regurgitation from an infant. In one embodiment the drool zones include the shoulder panels (60*a*), chest panels (60*b*) and sleeve panels (60*c*) of the garment.

Figure 3:
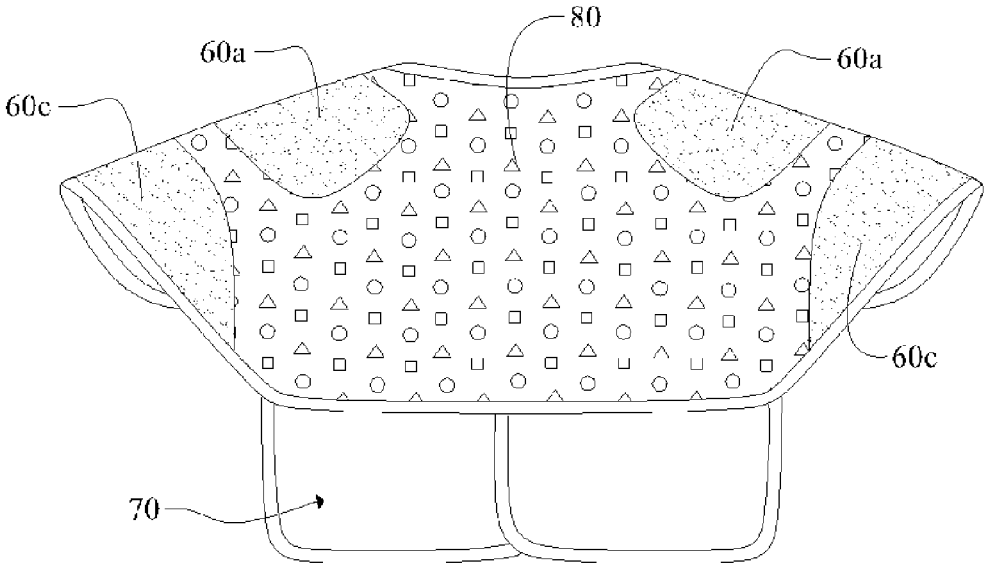
FIG. 3 is a rear perspective view of the inventive garment.

In another embodiment a fluid-impermeable layer (70) is sewn beneath the base material (80), thus protecting the wearer (FIG. 3). This material can be made from any wearable fluid-resistant material, such as nylon. FIG. 3 also illustrates one possible distribution pattern for the absorptive material when seen from the back.

Figure 4:
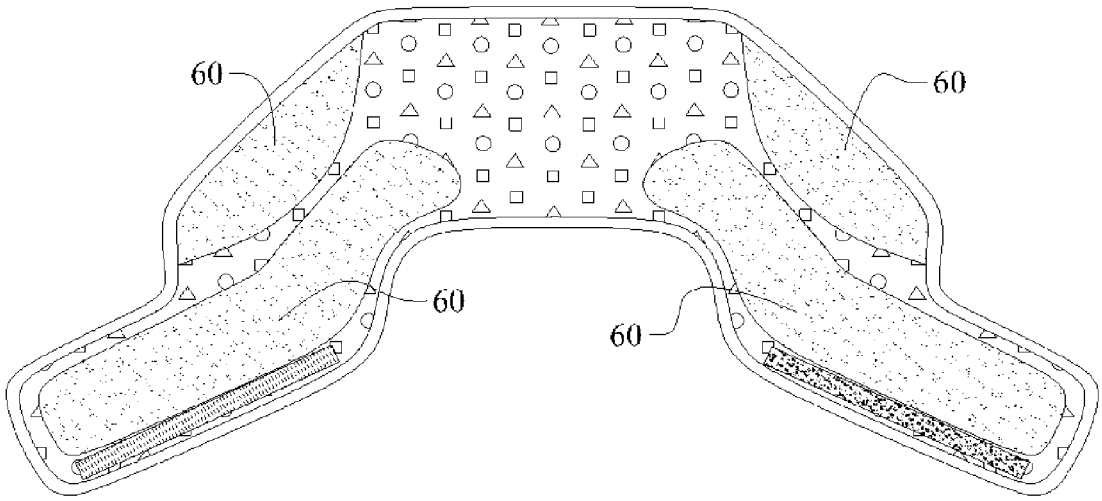
FIG. 4 is a perspective view of the obverse side of the inventive garment in an extended form.
Figure 5:
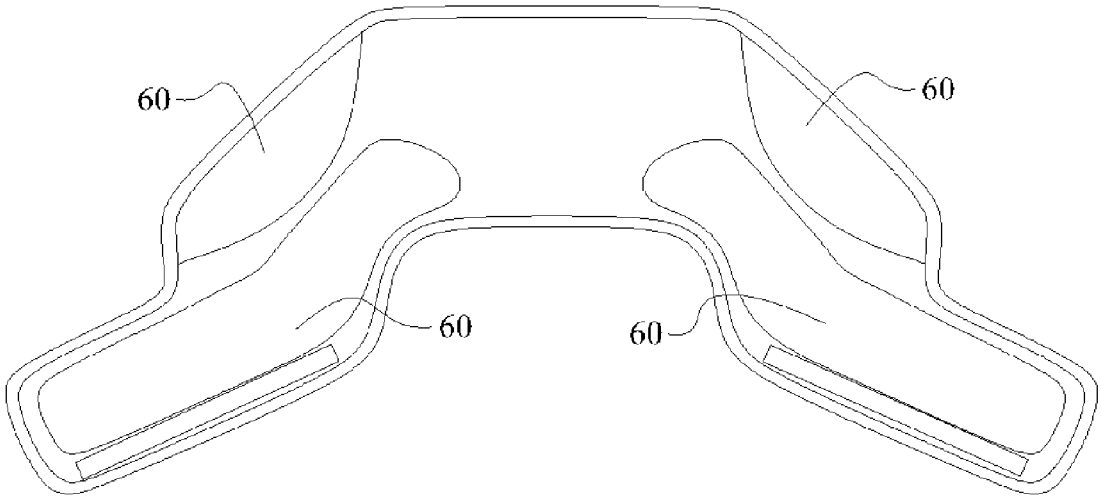
FIG. 5 is a perspective view of the reverse side of the inventive garment in an extended form.

Referring now to FIG. 4, the inventive apparatus can be seen in an extended form. In addition to the possible distribution of the absorptive material (60) over the base material (80), it can be seen how the fasteners (55) can be affixed to the corresponding chest panels. FIG. 5 shows a similar view from the reverse side of the garment.

It is understood that the above-described arrangement of the inventive apparatus is only illustrative of the application of the principles of the present invention. Numerous modifications and alternative arrangements may be devised by those skilled in the art without departing from the spirit and scope of the inventive apparatus and the claims are intended to cover such modifications and arrangements. For example, in addition to the illustrated configuration, it is noted that the inventive apparatus may also be designed so that the sides of the garment are closed, thus resembling a normal vest. Further, the inventive apparatus could comprise a single pieced front which affixes at its sides.

Similarly, variations in the type, size and location of the absorptive material are contemplated. For example, the absorptive material can comprise the entire garment, or an alternative proportion thereof. Accordingly, the absorptive material can also be placed in different patterns on the garment. Also, one skilled in the art would recognize that any number of conventional fasteners would be appropriate to connect the sides or front of the garment together.

Thus while the present invention has been shown in the drawings and fully described above with particularity and detail, it will be apparent to those of ordinary skill in the art that numerous modifications of the inventive apparatus, including but not limited to variations in size, materials, shape, form, function and manner of operation, assembly and use may be made without departing from the principles and concepts of the invention as set forth in the claims.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be the to fall therebetween. Now that the invention has been described,

What is claimed is:

1. A protective garment having an outer surface and inner surface for disposition over a user's clothes, comprising:

a back panel having an upper and a lower edge;

a pair of shoulder panels extending from the upper edge of the back panel, each shoulder panel having a medial end and a lateral end;

a neck opening having a peripheral border defined by the upper edge of the back panel and respective medial ends of said shoulder panels;

two chest panels, each having a medial and lateral side, depending from an associated shoulder panel, thereby defining a generally longitudinal opening between each chest panel and the back panel, in laterally spaced apart relation to one another, thereby defining a generally longitudinal opening there between;

wherein each chest panel has a greater lateral extent at its upper end and a lesser lateral extent at its lower end, thereby forming an inward curve;

at least one absorptive patch affixed to a panel chosen from the group consisting of chests shoulder, back and sleeve panels;

a fluid-resistant layer affixed to the inner surface of the garment forming a layer of protection between the user and the garment;

a fastener associated with at least one of the medial sides of the chest panels for releasably joining the chest panels together in overlapping fashion so that said generally longitudinal opening is closed releasably; and two sleeve panels extending from the lateral end of an associated shoulder panel and back panel, each sleeve panel being open along their entire extent and extending partially over the user's upper arm thereby providing additional protection.

2. The garment of claim 1, further comprising the fastener being chosen from a group of fasteners consisting of hook and loop, a zipper, buttons and cloth ties.

3. The garment of claim 1, wherein the chest, shoulder, back and sleeve panels are formed of an absorptive material.

4. The garment of claim 1, wherein each chest, shoulder, and back panel is equipped with an absorptive patch.

5. The garment of claim 1, wherein the sleeve panels are equipped with an absorptive patch.

* * * * *